United States Patent [19]

MacJannette

[11] 4,142,331

[45] Mar. 6, 1979

[54] BLADE SHARPENERS

[75] Inventor: Barrie MacJannette, Harrogate, England

[73] Assignee: GSPK (Electronics) Limited, Harrogate, England

[21] Appl. No.: 815,030

[22] Filed: Jul. 12, 1977

[30] Foreign Application Priority Data

Mar. 22, 1977 [GB] United Kingdom ..... 12119/77

[51] Int. Cl.[2] ..... B24B 3/54

[52] U.S. Cl. ..... 51/102; 51/135 R; 51/216 R

[58] Field of Search ..... 51/102, 128, 135 R, 51/208, 285, 216 R; 76/88, 89

[56] References Cited

U.S. PATENT DOCUMENTS

| | | | |
|---|---|---|---|
| 2,222,966 | 11/1940 | Williams | 51/135 R |
| 2,640,303 | 6/1953 | Johnson | 51/135 R |
| 2,677,218 | 5/1954 | Lamison | 51/135 R |
| 2,748,543 | 6/1956 | Pardee | 51/102 |
| 2,853,837 | 9/1958 | Lamison | 51/135 R |
| 3,501,871 | 3/1970 | Anderson | 51/102 X |

*Primary Examiner*—Nicholas P. Godici
*Attorney, Agent, or Firm*—Armstrong, Nikaido, Marmelstein & Kubovcik

[57] ABSTRACT

A blade sharpening or grinding device comprises an abrasive surface for acting on a blade edge, a second surface to receive a flat face of the blade to define the angle of the edge ground onto the blade, and a third surface to be abutted by the blade edge to limit the extent to which the blade is advanced into the abrasive surface. The second surface may be adjustable to vary the grinding angle and the second surface and/or the third surface may be adjustable to control the extent to which grinding takes place. Preferably the abrasive surface is provided on a belt driven over two pulleys by an electric motor.

16 Claims, 8 Drawing Figures

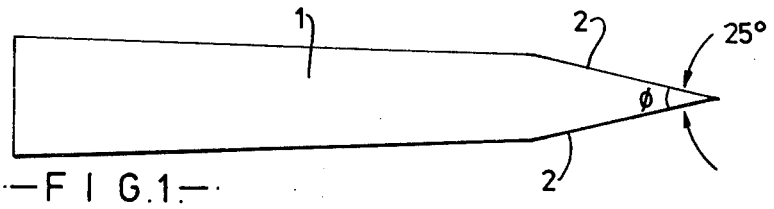
—FIG.1—
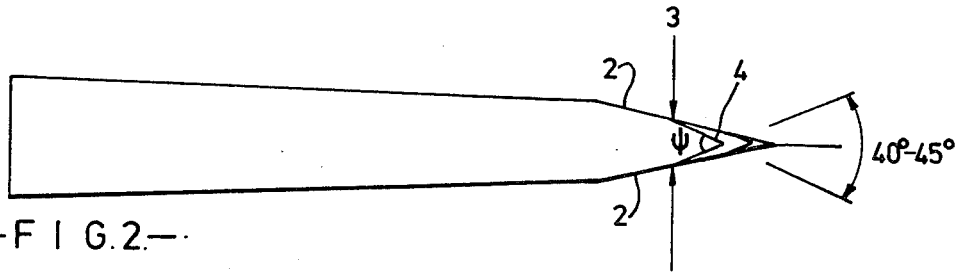
—FIG.2—
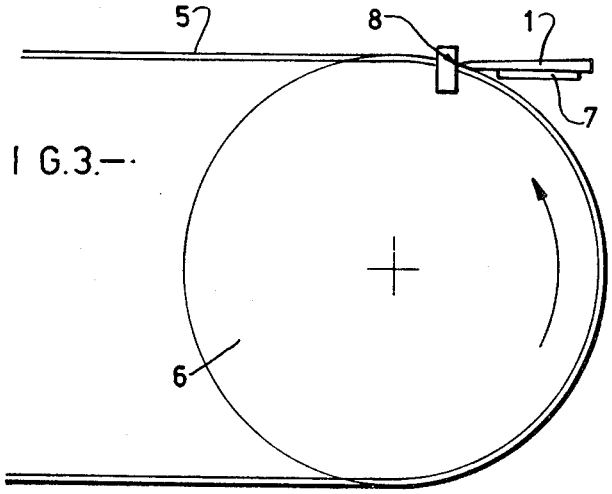
—FIG.3—
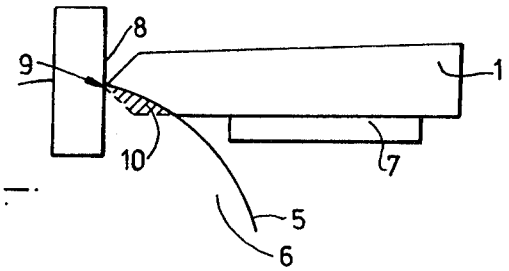
—FIG.4—

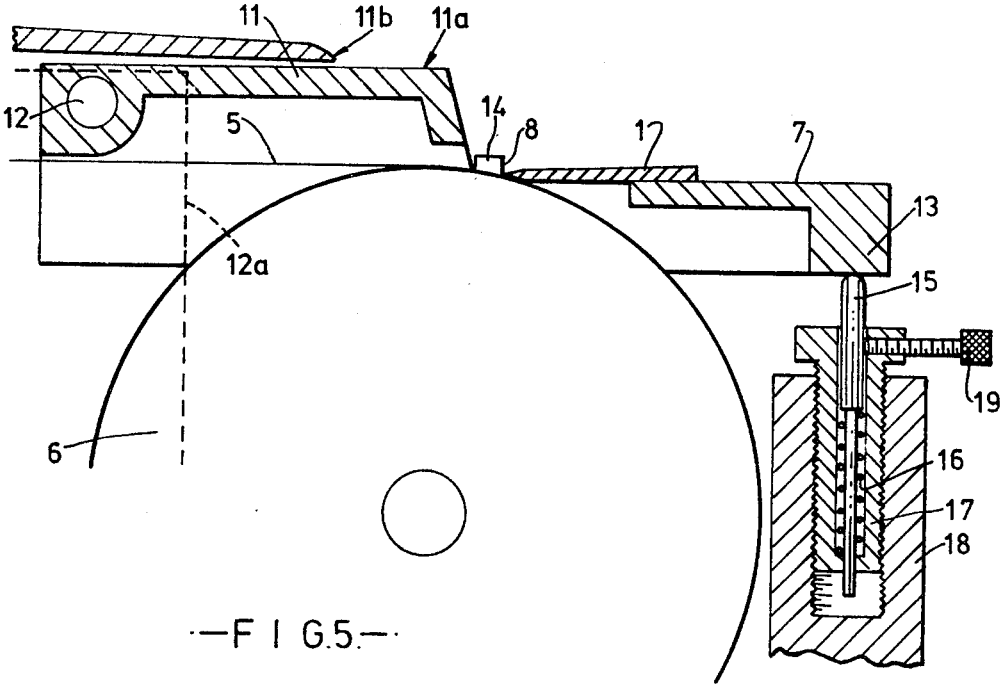
—FIG.5—
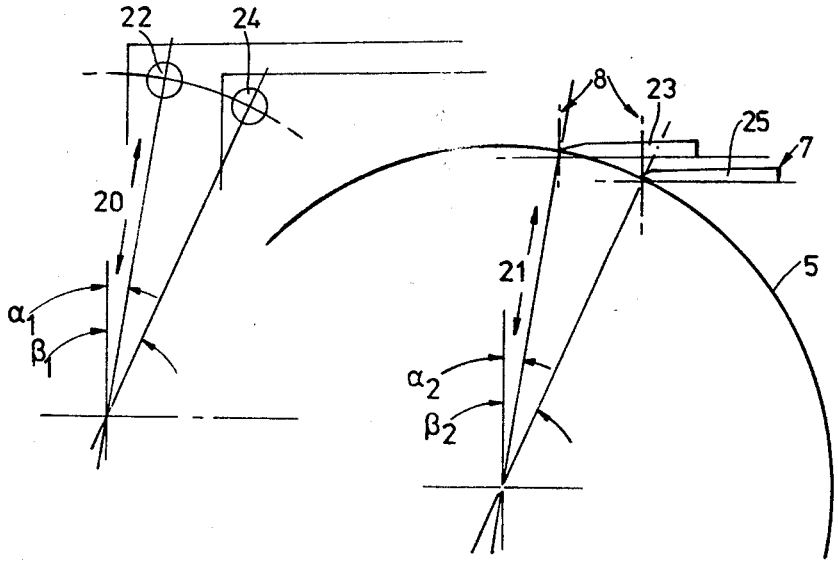
—FIG.6—

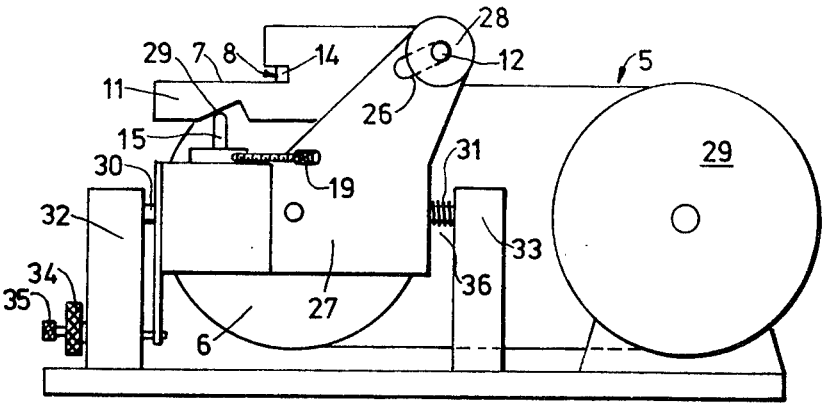
—FIG.7.—
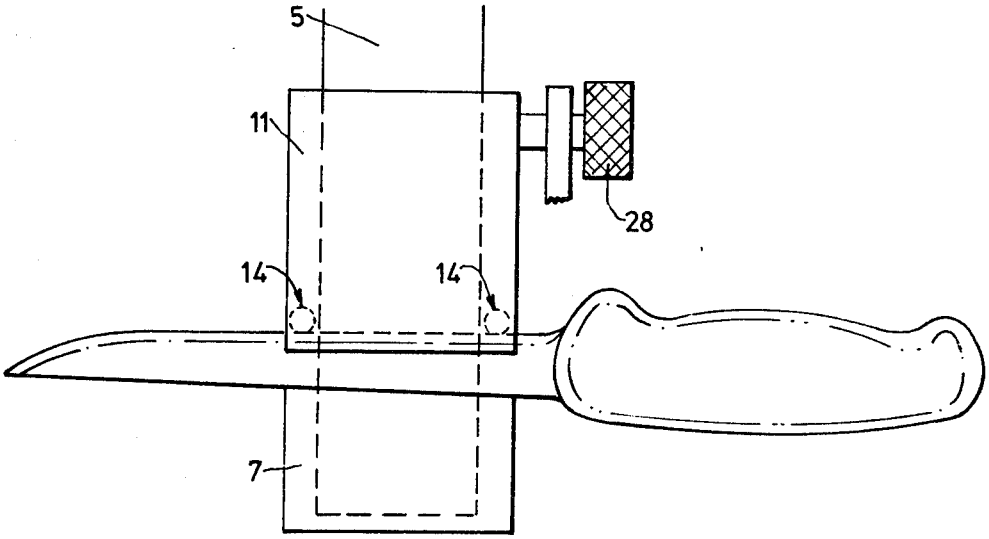
—FIG.8.—

BLADE SHARPENERS

BACKGROUND OF THE INVENTION

This invention relates to blade sharpening or grinding devices.

There are in existence a number of sharpening or grinding machines specifically intended for use with trade knives, i.e. knives employed by tradesmen such as meat packers and butchers etc. These machines employ an electrically driven grinding wheel or an abrasive belt. Some of these machines also have a means of controlling the angle ground onto the knife blade edge, but none have any means of controlling the amount of material removed during grinding, this being left to the skill of the operator.

Thus, one known blade sharpener is little more than a bench grinder consisting of an abrasive wheel attached to the shaft of an electric motor. A blade guide is provided for offering a blade to the wheel at a particular angle, but no means of limiting the amount of material removed from the blade edge is provided.

A further known blade sharpener or grinding comprises an abrasive belt driven over two flanged pulleys, and again a blade guide for presenting a blade to the belt at a particular angle. The blade guide is adjustable to vary the angle of presentation. The blade edge is presented to a portion of the belt which runs over a rigid metal platten arranged between the two pulleys. Here again, there is provided no means of limiting the amount of material removed from the blade edge.

SUMMARY OF THE INVENTION

It is the principle object of the invention to provide a blade sharpening or grinding device which itself defines the angle to which a blade edge is ground and itself also limits the amount of material to be removed from the blade edge, neither of these parameters being dependent upon the skill of the operator of the device.

According to the invention there is provided a blade sharpening or grinding device comprising a first surface for sharpening by abrasion an edge of a blade, a second surface for receiving a flat face of the blade to offer the blade edge to said first surface at an angle determined by said second surface thereby to determine the angle to which the blade edge is sharpened or ground, and a third surface arranged to be abutted by said blade edge so that the second and third surfaces together define a predetermined limit position for the blade edge with respect to said first surface, thereby to limit the amount of material removed from the blade edge in a sharpening or grinding process.

Relative movement between the blade and the aforementioned first surface may be provided by the blade edge being drawn across the first surface whilst the blade remains in contact with the second and third surfaces. The first surface may remain stationary; alternatively, however, the first surface itself may move to enhance the sharpening or grinding effect on the blade edge. For example, the first surface could be provided on a rotationally driven abrasive wheel, or on a driven abrasive belt, or be an oscillating abrasive surface. A further possibility is the use of a wheel, for example of cast iron, which will run in an abrasive slurry when in use to pick up abrasive particles.

The second surface may be adjustable to vary the angle to which the blade edge is to be sharpened. The second and/or third surfaces may also be adjustable to control the amount of material removed from the blade edge in a sharpening or grinding process.

In a preferred embodiment the second and third surfaces are provided on a blade guide member which is itself movable bodily, for example by pivoting, to facilitate adjustment of the second surface.

The third surface may comprise two part surfaces located one on either side of the first surface. These part surfaces may be curved or flat surfaces; in the former case they may be provided by pins. Where the pins are non-rotatable they should be of hard material which will not be cut by the blade. The edge of the blade to be sharpened or ground is placed in abutment with these part surfaces and drawn across the first surface whilst remaining in contact with said second surface.

BRIEF DESCRIPTION OF THE DRAWINGS

For a better understanding of the invention and to show how it may be put into effect reference will now be made, by way of example, to the accompanying drawings, in which:

FIG. 1 is a cross-section through the blade of a trade knife;

FIG. 2 also is a cross-section through the blade of a trade knife;

FIG. 3 illustrates the principle employed in the present invention;

FIG. 4 shows a detail of FIG. 3;

FIG. 5 shows in section part of a first embodiment of blade grinding machine according to the invention;

FIG. 6 illustrates diagrammatically one means of adjusting the sharpening or grinding angle of the machine of FIG. 5;

FIG. 7 is a side view of a second embodiment of grinding machine according to the invention; and FIG. 8 is a top view of part of the machine of FIG. 5 or 7 when in use grinding a knife.

DETAILED DESCRIPTION OF THE DRAWINGS

FIG. 1 is a enlarged cross section through the blade 1 of a trade knife. The sharpness of the knife blade 1 is largely determined by the edge angle $\phi$ included between cannels 2. A newly ground edge will ideally have an edge angle $\phi$ of about 25° as shown in FIG. 1. Chopping knives will have a rather larger angle $\phi$, to give a more robust edge.

When the blade edge is felt to become dull by the tradesman (e.g. butcher) using the knife, the tradesman sharpens the knife on a hand-held abrasive steel rod known as a steel. This creates a secondary cutting angle of about 40° to 45° superimposed on the primary 25° angle $\phi$. FIG. 2 shows this. The tradesman will habitually steel the knife edge almost every time he uses the knife, each time removing a small amount of material. When the blade edge has been steeled back as far as position 4, the thickness of blade across the cannels 2 at a point indicated by arrows 3 in FIG. 2 is about 0.2 to 0.3 mm thick. The edge thus starts becoming difficult to steel, as more material has to be removed to re-establish a sharp edge. At this point the knife is felt to be ready for re-grinding. This operation regains the original 25° primary cutting angle $\phi$, making the knife sharp and easy to steel again. The knife sharpeners we have developed are intended for use in re-grinding this primary cutting angle onto trade knives and similar cutting edges.

FIG. 3 indicates diagrammatically parts of the grinding machine which we have developed. A belt 5 having an abrasive outer surface extends around a wheel 6. The belt 5 is driven by a further wheel driven by an electric motor (not shown). The machine comprises datum surfaces 7 and 8 forming means whereby the amount of material removed from the blade edge during sharpening or grinding can be controlled. Datum surface 7 is provided on a flat plate on which a flat side of the blade 1 rests, presenting blade 1 at the correct angle of approach to the belt 5 in order to produce the desired edge angle $\phi$. At the region where the blade edge contacts the abrasive belt 5 the latter is supported on the edge of the wheel 6 to provide a firm grinding surface. In this way the angle ground onto the blade edge is determined. Datum surface 8 is provided by a pair of hardened tool steel pins, rollers or other devices, one device being at each side of the abrasive belt 5, i.e. one behind the other into the Figure. Instead of the abrasive belt 5, a grinding wheel may be employed to grind the blade edge, or an oscillating abrasive surface.

When the machine is in use the belt 5 is set in motion and the knife blade 1 is hand-held flat on the datum surface 7. Whilst keeping the blade 1 lightly in contact with the datum surfaces 8 and flat on the datum surface 7 with one hand, the knife is drawn across the abrasive belt slowly, with the other hand, starting from the handle end of the knife. The blade 1 is then turned over and the process repeated on the other side of the blade 1. Where the blade 1 is curved at the end, care must be taken to follow the shape of the curve.

FIG. 4 is a detail of FIG. 3 and indicates that when the projections of the datum surfaces 8 and the abrasive surface of the belt 5 intersect at a point 9 corresponding to half the thickness of the knife blade 1, a quantity of material 10 will be ground from the blade 1 which is the minimum amount which can be removed to re-form the required cannel form on that side of the blade 1. Furthermore, once that material has been removed it is impossible to remove more material, provided that the point 9 is not ground away, without altering the relationship of the datum surfaces 7 and 8 to the abrasive surface of the belt 5. This is the ideal grinding situation, but in practice it is rarely achieved. Moreover in practice this is not vitally important, an illustration of the ideal condition has been given merely to assist in understanding how the machine operates.

Part of a knife sharpening machine which employs an adjustable blade guide is shown in section in FIG. 5. Here, the datum surfaces 7 and 8 are in fact provided on a blade guide member 11 fitted about an axle 12 which is fixed to the chassis (not shown) of the grinding machine. The knife blade 1 rests as shown on a horizontal support 13 which provides the datum surface 7, and abuts against two guide pins 14 which provide the datum surfaces 8 at each side of the abrasive belt 5 on the wheel 6.

For adjustment of the material to be removed, the right hand end of the blade guide member 11 is free to move vertically by pivoting of the member 11 about the axle 12. In so doing the right hand end of the blade guide member 11 will move a spring loaded stop plunger 15 on which it bears. The plunger 15 is supported by a spring 16 in a threaded body 17 which is free to turn in a threaded hole in a support member 18 which is part of the chassis of the machine. A locking screw 19 passes through one wall of the threaded member 17 and, when tightened against the stop plunger 15, fixes the position of the plunger 15 relative to the threaded body 17.

Setting the correct position of the blade guide member 11 to achieve a desired depth of grinding cut is carried out as follows. Initially the locking screw 19 is slackened so that the stop plunger 15 is free to slide up and down in the threaded body 17. The blade 1 to be sharpened or ground is held by the operators' fingers flat on the datum surface 7 and in abutting contact with the two pins 14 on either side of the belt 5 and providing the datum surfaces 8. With the drive motor switched off so that the abrasive belt 5 is stationary, the blade 1 and with it the blade guide member 11 are pressed downwardly by the operator against the force of the spring 16 until the edge of the blade 1 is felt to contact the abrasive surface of the belt 5. The locking screw 19 is then tightened, thus fixing the position of the edge of the blade 1 relative to the abrasive surface of the belt 5. The blade guide member 11 is then pivoted downwards by a small amount more, equivalent to the amount of material to be removed from the edge of the blade 1, by turning the threaded body 17 in its socket in the support member 18 in a clockwise manner as viewed from above. The threads on the threaded body 17 and in the support member 18 cooperate to lower the stop plunger 15 by a small amount depending upon the amount through which the threaded body 17 is turned. By this means, precise control is gained over the amount of material removed when, subsequently, the motor driving the abrasive belt 5 is switched on and the blade 1 to be sharpened is drawn across the blade guide member 11 in a direction perpendicular to the plane of FIG. 5. Visual inspection of the cannels produced on either side of the blade provides the necessary information as to whether the settings were correctly made or whether further adjustment is necessary to correct, say, insufficient depth of cut, or excessive depth of cut leading to unequal cannels.

It may be desirable to provide stops (not shown) which are cooperable with the locking screw 19 to restrict rotation of the threaded body 17 to a predetermined angular range providing a predetermined lowering of the stop plunger 15. One suitable example of such a predetermined lowering is four one-thousandths of an inch.

In alternative embodiments the blade guide member 11 could be horizontally, instead of vertically, movable in order to adjust the amount of material to be removed from the blade edge. In this case the two guide pins 14 would be horizontally positionally adjustable with respect to the wheel 6 to adjust the amount of material to be removed. This could be achieved by the blade guide member 11 being fixed to a horizontally movable part **12*a*** of the chassis of the machine.

It will be appreciated that pivoting the blade guide member 11 about an axle 12 will not only vary the depth of grinding cut, but also the grinding angle. However, the latter varies only very slightly since the distance from the blade edge to the axle 12 is large compared with the very small amount by which the height of the plunger 15 is varied to vary the depth of grinding cut. The plunger 15 may be adjusted to accommodate blades up to 5 mm thick.

FIG. 6 indicates diagrammatically a further feature of the blade guide member 11 of FIG. 5, in that a significant adjustment may be made to the angle ground onto the edge of the blade 1 by moving the position of the axle 12 along an arc parallel to the curvature of the abrasive surface of the belt 5 where it extends on the wheel 6 and is contacted by the blade edge. If an initial angle $\alpha_1$ between the vertical and the radius 20 of the axle 12 is the same as the initial angle $\alpha_2$ between the vertical and a radius 21 of the wheel 6 to the blade edge, then any subsequent movement of the axle 12 along the aforementioned arc will cause a change in the angles $\alpha_1$ and $\alpha_2$ and thus a change in the attitude of the blade 1 to the abrasive surface of the belt 5. When the axle 12 is in a position 22 as shown in FIG. 6 $\alpha_1 = \alpha_2$ and the blade 1 is in a position 23 having a relatively narrow angle ground onto its edge. When the axle 12 is moved to a position 24, $\alpha_1$ and $\alpha_2$ increase to equal angles $\beta_1$ and $\beta_2$ and the blade 1 moves to position 25. The blade 1 thus has a wider angle ground onto its edge because the blade 1 is in contact with the belt 5 at a wider angle. Where the arc between positions 22 and 24 of the axle 12 is small, movement of axle 12 in a straight line between positions 22 and 24 is an adequate approximation to the arc.

Preferably, the position of the axle 12 is moveable such that the angle $\phi$ between the cannels 2 of the blade 1 (see FIG. 1) is adjustable in the range from 15° for slicing knives to 35° for chopping knives. The belt 5 should not be in motion when the axle 12 is being positionally adjusted.

An upper surface 11*a* of the blade guide member 11 is in the form of a scale graduated between 15° and 35° which cooperates with a fixed edge 11*b* of a casing of the machine. The scale is arranged so that it provides an indication of the cannel angle $\phi$ which the blade guide member 11 is set to produce, the fixed edge 11*b* acting in the manner of a pointer on the scale.

FIG. 7 shows an embodiment of grinding machine comprising all the components of FIG. 5, but in a slightly different arrangement. Here, the blade guide member 11 comprises a flat plate defining datum surface 7 upon which to rest the flat side of a knive blade. Tool steel pins 14 again define the datum surfaces 8. The locking screw 19 is provided for adjusting the plunger 15, but the plunger 15 abuts the underside of the blade guide member 11 at the side as opposed to at the end. No differences in function is provided by this change of position. The blade guide member 11 is permanently free to pivot about the axle 12.

The axle 12 is retained in a slot 26 in a chassis member 27. When a knurled knob 28 is loosened the axle 12 is free to move in the slot 26 to adjust the grinding angle as indicated in FIG. 6. An inclined surface 29 is provided in the blade guide member 11 to contact the plunger 15. The surface 29 is parallel to the slot 26. When the axle 12 is moved the surface 27 slides along the surface 29 thus maintaining constant the inclination of the blade guide member 11.

The belt 5 is driven by a two-pole electric motor 29 which rotates a wheel over which the belt 5 extends at the motor 29. Preferably the wheel driven by the motor 29 has a crown or domed periphery to keep the belt 5 running centrally on it.

The chassis member 27 which carries the blade guide member 11 and the wheel 6 is pivotally mounted on shafts 30 and 31, which are supported in columns 32 and 33. To adjust tracking of the belt 5 on the wheels 6 and 29 should it not be running centrally, a nut 34 is slackened and a knob 35 rotated very slightly one way or the other. The chassis member 27 with the wheel 6 pivots slightly about shafts 30 and 31 to allow the belt 5 to be re-adjusted.

The chassis member 27 is longitudinally displaceable on the shafts 30 and 31 and is biased away from the motor 29 by a spring 36 on the shaft 31. This automatically tensions the belt 5.

FIG. 8 is a top view of the blade guide member 11 of either FIG. 5 of FIG. 7. The datum surface 7 with a knife blade thereon is shown, as are the pins 14 on each side of the belt 5. A knife is shown in the position it will occupy at the beginning of a grinding pass across the abrasive belt 5.

Correct grinding conditions are maintained in our machines by the use of a polymeric backing wheel 6, on which the abrasive belt 5 runs, which is of controlled resilience. The belt 5 itself is a fully resin bonded corundum cloth type, of correct grit size. The belt is preferably driven by a two pole motor which maintains the correct grinding speed.

Our machines are designed to be virtually maintenance free: use has been made of self-lubricating bearings, the motor is sealed against abrasive dust and the only attention required is to change the abrasive belt 5 when it wears out.

Our machines are based on our feeling that effective control of the amount of material removed during sharpening or grinding is essential to the correct establishment of blade edge condition, so much so that it should be controlled by the machine and not left to the skill of the operator. Reasons for such control being important are: firstly, excessive material removal shortens the working life of the knife as it will be ground away until the blade is too narrow, sooner than necessary; secondly, removal of large amounts of metal generates substantial heat due to the mechanical energy expended. This can be sufficient to overheat the blade, causing loss of hardness of the material and, with stainless steel blades, reduction of corrosion resistance may result. Therefore, if only a minimum amount of material is removed, a minimum amount of heat will be generated thus reducing these effects, third, it is almost impossible, when grinding by hand, to remove an equal amount of material from both sides of the blade, resulting in an assymetric edge, i.e. the cannel is wider one side than the other. This can make steeling difficult, and can result in the blade "steering" to one side as a cut is made and; fourthly, if uneven amounts of material are removed along the length of the blade, the blade will become wavy along its length making it difficult to use.

I claim:

1. A blade sharpening device comprising:

a first surface for sharpening by abrasion an edge of a blade;

a second surface for receiving a flat face of the blade to offer the edge of said blade to said first surface at an angle determined by said second surface thereby to determine the angle to which said edge is sharpened;

a third surface arranged to be abutted by said edge so that said second and third surfaces together define a predetermined limit position for said edge with respect to said first surface, thereby to limit the amount of material removed from said edge in a sharpening process;

positioning means comprising a resiliently loaded member which is arranged to cooperate with a movable one of said second and third surfaces, in response to movement of said one surface and with a blade to be sharpened in abutment with said second and third surfaces, to allow said one surface to achieve by said movement a reference position for said one of said second and third surfaces in which said blade edge contacts said first surface; and depth-of-cut adjustment means operable prior to a sharpening process to move the position of said one of said second and third surfaces from said reference position by a precisely controlled small amount to a further position, thereby to define the amount of material to be removed from said blade edge in the sharpening process.

2. A blade sharpening device as claimed in claim 1, wherein said second surface is said one surface.

3. A blade sharpening device as claimed in claim 2, wherein said second surface is movable by means of it being a surface on a pivotably mounted blade guide member.

4. A blade sharpening device as claimed in claim 1, wherein said resiliently loaded member is a spring loaded plunger.

5. A blade sharpening device as claimed in claim 1, wherein said positioning means comprises a locking means operable to prevent said one of said second and third surfaces moving beyond said reference position prior to operation of said depth-of-cut adjustment means.

6. A blade sharpening device as claimed in claim 1, wherein said depth-of-cut adjustment means comprises a screwthreaded member rotatable to move said one of said second and third surfaces by an amount dependent upon the axial movement of said screwthreaded member in response to its rotation.

7. A blade sharpening device as claimed in claim 6, wherein said spring loaded member is carried by said screwthreaded member and is positionally lockable with respect thereto to define said reference position.

8. A blade sharpening device as claimed in claim 1, wherein said first surface is provided on an abrasive belt driven over two wheels by an electric motor, there being tracking means operable to adjust the angle of tilt of one of said two wheels thereby to ensure that the belt remains running centrally on said two wheels.

9. A blade sharpening device as claimed in claim 1, wherein said third surface is defined by two part surfaces arranged one on either side of said first surface.

10. A blade sharpening device as claimed in claim 1, wherein said second and third surfaces are provided on a single pivotably mounted blade guide member, and are immovable with respect to one another.

11. A blade sharpening device comprising:

a first surface for sharpening by abrasion an edge of a blade;

a second surface for receiving a flat face of the blade to offer the edge of said blade to said first surface at an angle determined by said second surface thereby to determine the angle to which said edge is sharpened;

a third surface arranged to be abutted by said edge so that said second and third surfaces together define a predetermined limit position for said edge with respect to said first surface, thereby to limit the amount of material removed from said edge in a sharpening process;

positioning means arranged to cooperate with a movable one of said second and third surfaces, in response to movement of said one surface and with a blade to be sharpened in abutment with said second and third surfaces, to allow said one surface to achieve by said movement a reference position for said one of said second and third surfaces in which said blade edge contacts said first surface;

depth-of-cut adjustment means operable prior to a sharpening process to move the position of said one of said second and third surfaces from said reference position by a precisely controlled small amount to a further position, thereby to define the amount of material to be removed from said blade edge in the sharpening process; and angle adjustment means operable to adjust said angle at which said second surface will offer the edge of said blade to said first surface, said depth-of-cut adjustment means and said angle adjustment means being operable independently of one another.

12. A blade sharpening device as claimed in claim 11, wherein said second surface is said one surface and is provided on a blade guide member which is mounted to be pivotable about an axis in dependence upon said positioning means and said depth-of-cut adjustment means, said angle adjustment means being operable to move said axis bodily independently of said depth-of-cut adjustment means, thereby to adjust said angle at which said second surface will offer the edge of said blade to said first surface.

13. A blade sharpening device as claimed in claim 12, wherein said first surface is curved and said blade guide member rests on a member at a portion of said blade guide member which extends parallel to the path taken by said axis when it is moved bodily.

14. A blade sharpening device as claimed in claim 11, wherein said first surface is provided on an abrasive belt driven over two wheels by an electric motor, there being tracking means operable to adjust the angle of tilt of one of said two wheels thereby to ensure that the belt remains running centrally on said two wheels.

15. A blade sharpening device as claimed in claim 11, wherein said third surface is defined by two part surfaces arranged one on either side of said first surface.

16. A blade sharpening device as claimed in claim 11, wherein said second and third surfaces are provided on a single pivotably mounted blade guide member, and are immovable with respect to one another.

* * * * *